US005406724A

United States Patent [19]

Lin

[11] Patent Number: 5,406,724

[45] Date of Patent: Apr. 18, 1995

[54] SIMPLIFIED ILLUMINATING MEANS FOR SAFETY ILLUMINATED SHOE

[76] Inventor: Wen-Tsung Lin, P.O. Box 74-9, Taipei, Taiwan, Prov. of China

[21] Appl. No.: 290,569

[22] Filed: Aug. 15, 1994

[51] Int. Cl.[6] ..... A43B 23/00; F21L 15/08

[52] U.S. Cl. ..... 36/137; 36/136; 362/103

[58] Field of Search ..... 36/137, 136; 362/103, 362/800

[56] References Cited

U.S. PATENT DOCUMENTS

| | | | |
|---|---|---|---|
| 5,188,447 | 4/1994 | Wu | 362/103 |
| 5,285,586 | 2/1994 | Goldston et al. | 36/137 |
| 5,303,131 | 4/1994 | Wu | 36/137 X |
| 5,357,697 | 10/1994 | Lin | 36/137 |

*Primary Examiner*—Jimmy G. Foster

*Assistant Examiner*—Ted Kavanaugh

[57] ABSTRACT

An illuminating device for safety illuminated shoe includes: a retaining base fixed in a transparent holder in a shoe heel for securing a printed circuit board on the retaining base, a restoring trigger switch formed in a laminate sheet of the printed circuit board by directly punching the laminate sheet for decreasing production cost to form a resilient blade member having an electrically conductive foil plated on a bottom of the resilient blade member, and a battery attached to a bottom of the printed circuit board with a negative pole of the battery positioned under the resilient blade member to be normally separated from the resilient blade member, whereby upon treading of the shoe to depress the resilient blade member downwardly to contact the electrically conductive foil with the negative pole of the battery for powering and illumiating the illuminators through the transparent holder in the shoe heel.

4 Claims, 6 Drawing Sheets

SIMPLIFIED ILLUMINATING MEANS FOR SAFETY ILLUMINATED SHOE

BACKGROUND OF THE INVENTION

In a U.S. patent application entitled "Safety Illuminated Shoe" filed on Feb. 10, 1994 with a Ser. No. 08/194,395, now U.S. Pat. No. 5,357,697 now granted to the same applicant of this application, there is provided with a safety illuminated shoe including a plurality of illuminators secured on a printed circuit board having a flip-flap trigger switch mounted on the printed circuit board and electrically connected between two poles of a power source of batteries packed under the printed circuit board for supporting the printed circuit board as shown in FIG. 1, whereby upon treading of the shoe to close two contacts of the flip-flap trigger switch, the illuminators will be lit up for a predetermined time period as controlled by an integrated circuit built on the printed circuit board.

However, such a prior art may have the following drawbacks:

1. The flip-flap trigger switch 23 of the illuminating means 2 includes an upper disk portion 231 and a lower contactor plate 234, depressibly contacted with each other for triggering the illuminators. Both the disk portion 231 and the lower contactor plate 234 should be welded or fixed on the printed circuit board 22 to increase the assembly and production cost.
2. Once the on-off main switch 27 is on, the power of the batteries 24 will be continuously consumed to shorten the service life of the batteries 24 when wearing and treading the shoe to light the illuminators 26 even at day time.

In view of the prior arts of illuminated footwears or switches for the illuminated footwears such as disclosed in U.S. Pat. Nos. 5,303,131, 5,188,447, 4,848,009, 4,253,253, 4,128,861, 4,014,115, and 3,800,133, there is not provided with any simpler switch device for automatically switching on or off the power supply to the flashing or illuminating footwears.

It is therefore desirous to invent a switch, simpler in structure and cheaper in cost, for the control of the illumination of the flashing footwears.

SUMMARY OF THE INVENTION

The object of the present invention is to provide an illuminating device for safety illuminated shoe including: a retaining base fixed in a transparent holder in a shoe heel for securing a printed circuit board on the retaining base, a restoring trigger switch formed in situ in a laminate sheet of the printed circuit board by directly punching the laminate sheet for decreasing a production cost to form a resilient blade member having an electrically conductive foil plated on a bottom of the resilient blade member, and a battery attached to a bottom of the printed circuit board with a negative pole of the battery positioned under the resilient blade member to be normally separated from the resilient blade member, whereby upon treading of the shoe to depress the resilient blade member downwardly to contact the electrically conductive foil with the negative pole if the battery for powering and illumiating the illuminators through the transparent holder in the shoe heel.

DETAILED DESCRIPTION

Figure 1:
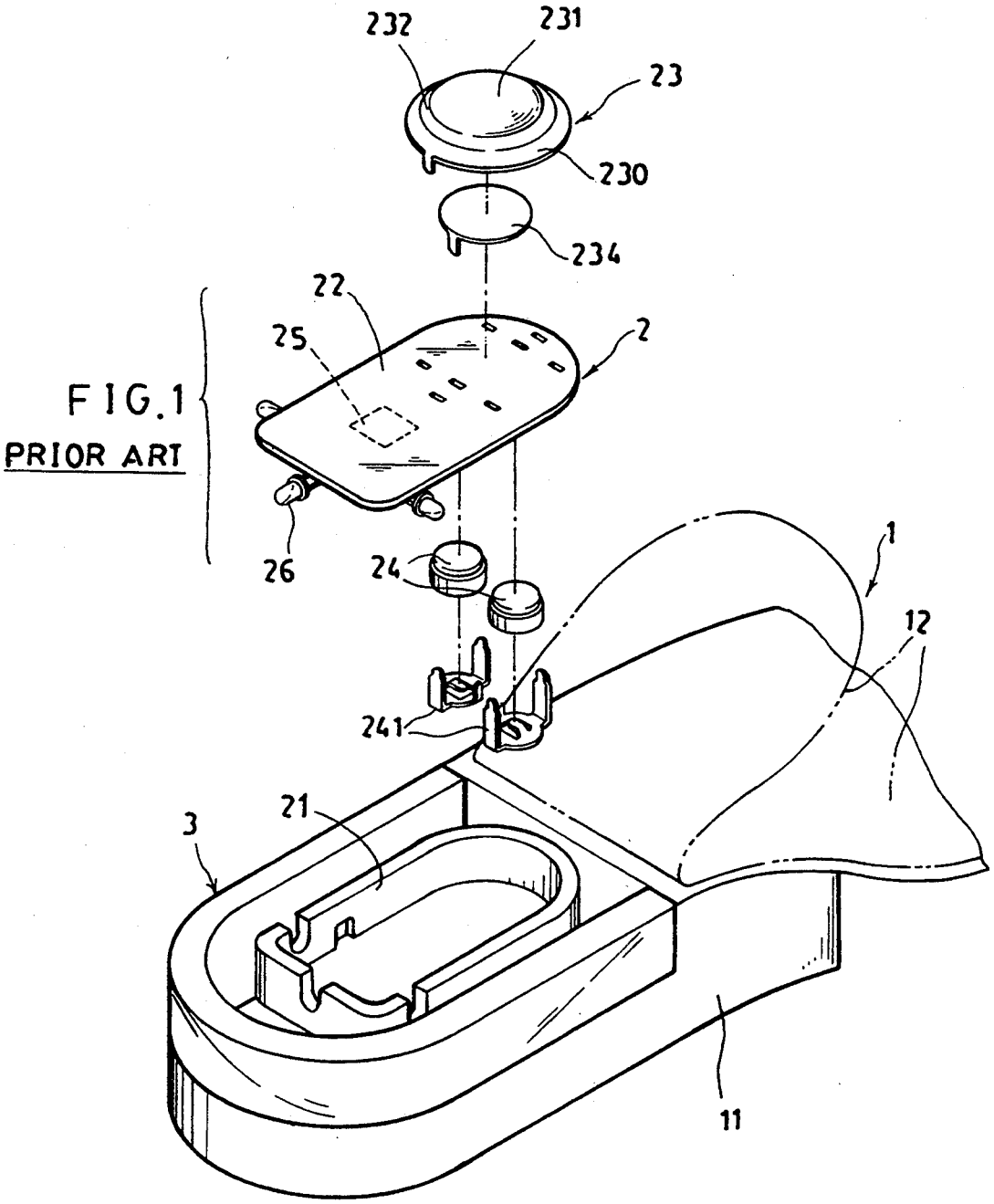
FIG. 1 PRIOR ART
FIG. 1 shows a prior art of safety illuminated shoe also invented by the same inventor of this invention.

As shown in FIGS. 2–6, an illuminating means 2 of the present inventiom is secured in a transparent holder 3 formed in a rear recess 111 in the heel 11 of a safety illuminated shoe 1, with an insole 12 of the shoe 1 covering an upper portion of the illuminating means 2 of the present invention.

Figure 2:
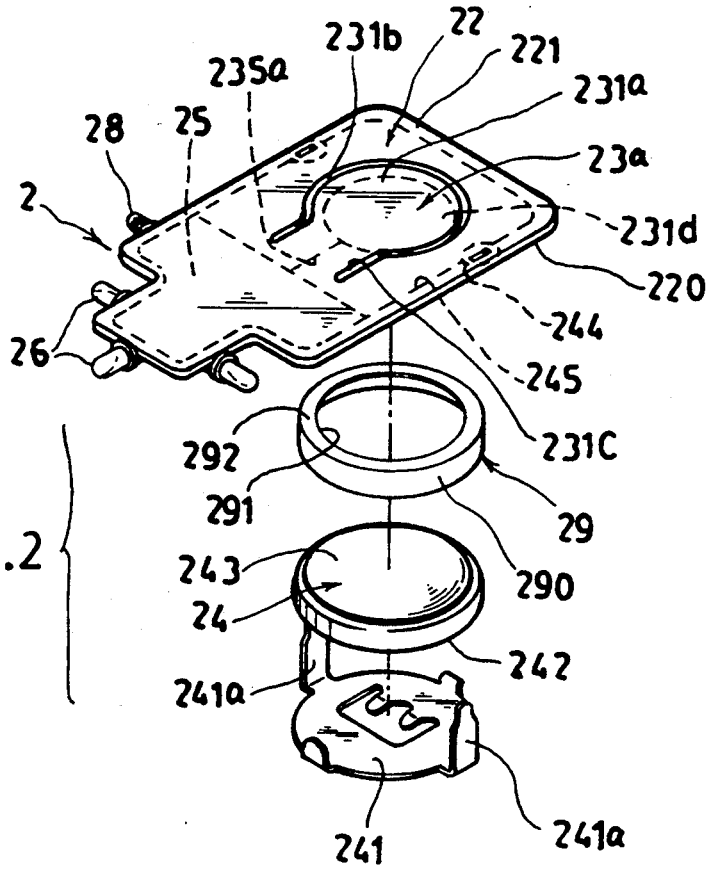
FIG. 2 is an exploded view showing the parts of the illuminating means of the present invention.
Figure 3:
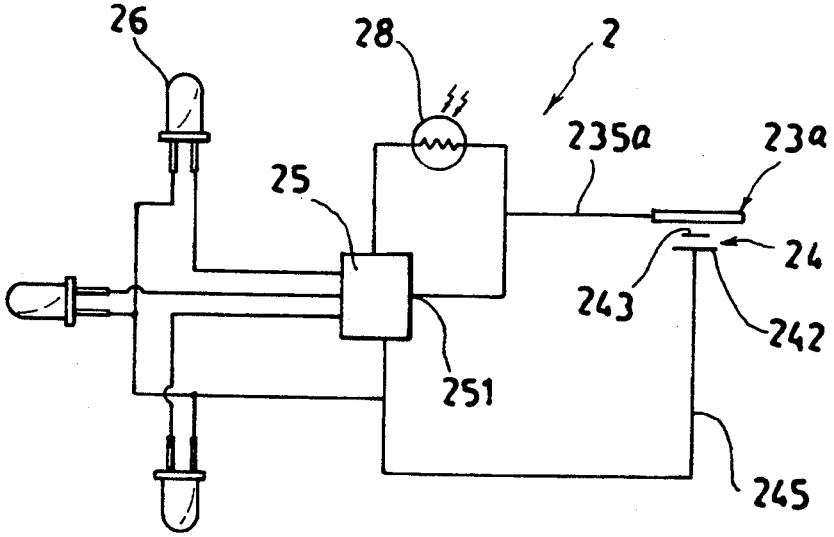
FIG. 3 is an electronic circuit of the present invention.
Figure 4:
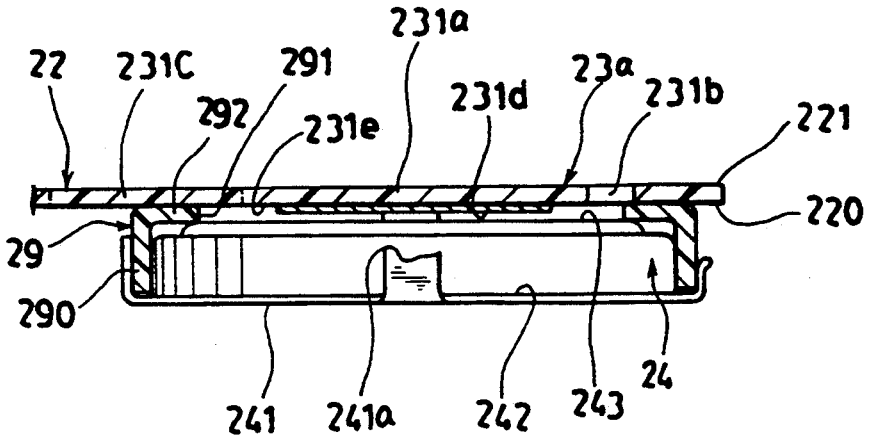
FIG. 4 is a partial sectional drawing of the present invention.

The illuminating means 2 includes: a retaining base 21 made of electrically insulative material and embedded in the transparent holder 3 in the heel 11 of the shoe 1, a printed circuit board 22 secured in an upper portion of the base 21 and having an electrically insulative laminate sheet 221 and an integrated circuit 25 printed in the laminate sheet 221, a restoring trigger switch **23*a* formed in situ in the laminate sheet 221, a battery 24 of button cell such as of 3 V attached to the laminate sheet 221 of the printed circuit board 22, a plurality of illuminators 26 secured on the printed circuit board 22 and controlled by the integrated circuit 25 for a timing control of the illumination of the illuminators 26, a photoresistive switch 28 electrically connected between the battery 24 and the integrated circuit 25 through the trigger switch 23*a* as shown in FIGS. 3, 2 for powering the illuminators 26 and the integrated circuit 25 at night or darkness, and an electrically insulative washer 29 packed between a bottom 220 of the laminate sheet 221 of the printed circuit board 22 and the battery 24 to normally separate the trigger switch 23*a* from the battery 24 as shown in FIG. 4**.

Figure 5:
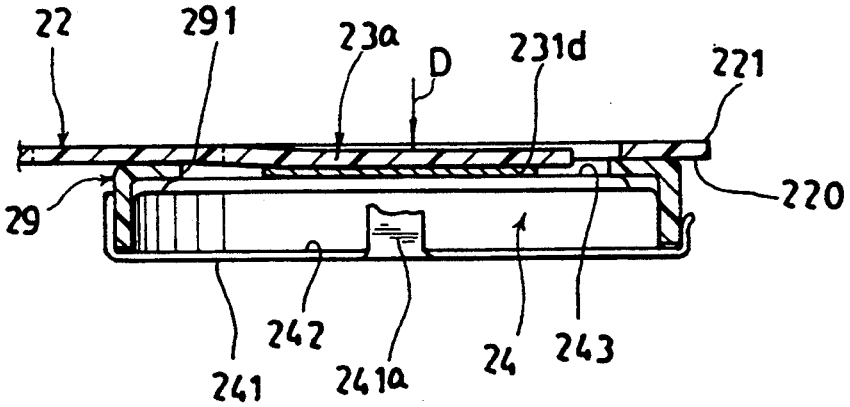
FIG. 5 is an illustration showing a depression on the trigger switch of the present invention.
Figure 6:
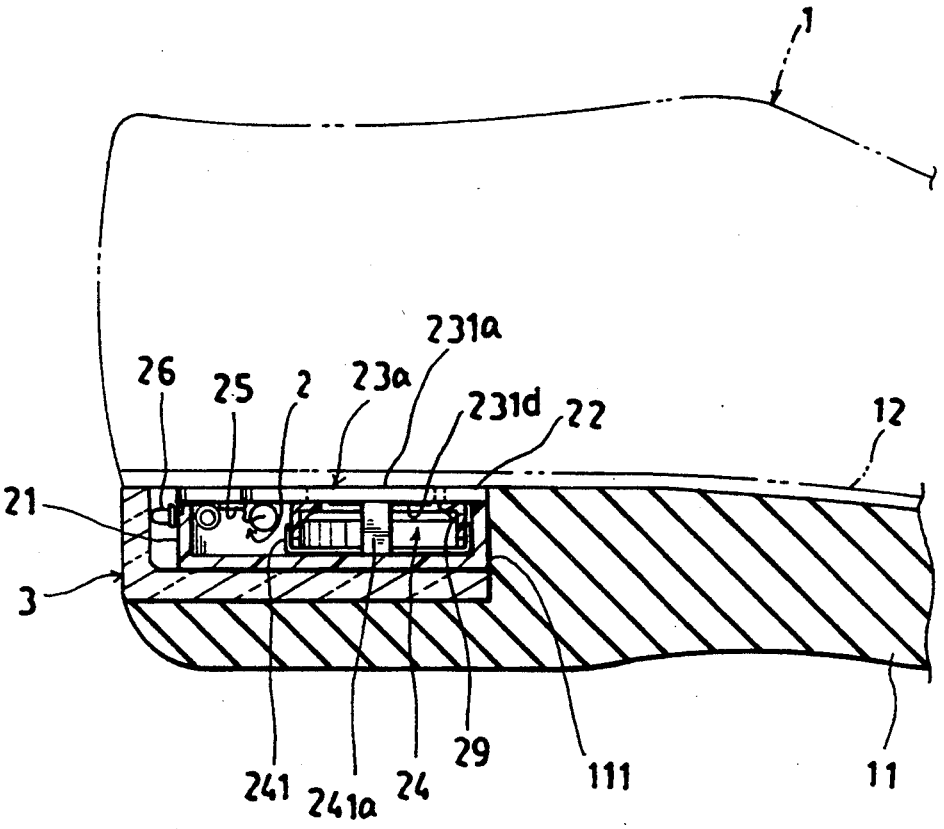
FIG. 6 is an illustration showing a safety shoe mounted with the present invention.

The restoring trigger switch **23*a* of the illuminating means 2 includes: a resilient blade member 231*a* generally omega shaped and directly punched from the electrically insulative laminate sheet 221 of the printed circuit board 22 to form a punching slit 231*b* generally omega shaped with a connector portion 231*c* connecting the resilient blade member 231*a* to the laminate sheet an electrically conductive layer or foil 231*d* plated or printed on a bottom of the resilient blade member 231*a* and electrically connected to a trigger pin 251 of the integrated circuit 25 of the illuminating means 2 by a negative leading wire 235*a*; the battery of button cell 24 jacketed in the electrically insulative washer 29 and held in a battery bracket 241 and positioned under the resilient blade member 231*a*, the battery bracket 241 made of electrically conductive material having at least two clips 241*a* secured to the laminate sheet 221 of the printed circuit board 22 with a positive pole 242 formed on a bottom of the battery 24 contacted with the battery socket 241, the clips 241***a* and electrically connected to the integrated circuit 25 through a positive leading wire 245 and a soldering joint 244 connecting each clip 241*a* with the positive leading wire 245, and with a negative pole 243 of the battery 24 formed on a top of the battery 24 positioned below and adjacent to the electrically conductive foil 231*d* of the resilient blade member 231*a*; and the insulative washer 29 having a shallow cylinder portion 290 disposed around the battery 24 of button cell, an annular rim 292 formed on a top portion of the cylinder portion 290 and defining a central opening 291 within the annular rim 292 with the annular rim 292 packed between the laminate sheet 221 of the printed circuit board 22 with the negative pole 243 of the battery 24 for normally separating the electrically conductive foil 231*d* from the negative pole 243 of the battery 24; whereby upon treading of the shoe by a shoe wearer (such as "D" as shown in FIG. 5), the resilient blade member 231*a* will be depressed downwardly to allow the electrically conductive foil 231*d* to contact the negative pole 243 of the battery 24 of which the positive pole 242 is electrically connected to the integrated circuit 25, thereby closing two contacts of the trigger switch 23*a* for triggering and powering the integrated circuit 25 and the illuminators 26 for the illumination of the illuminators; and upon releasing of the treading of the shoe when the shoe wearer lifts the shoe, the resilient blade member 231*a* will be automatically restored by its self resilience to be horizontally straightened as shown in FIG. 4 to disconnect the foil 231*d* from the negative pole 243 of the battery 24 for opening the trigger switch 23*a*.

The area of the central opening 291 of the insulative washer 29 should be larger in area than that of the resilient blade member 231*a*, thereby allowing a downward depression of the blade member 231*a* to contact the foil 231*d* on the bottom of the blade member 231*a* with the negative pole 243 of the battery 24.

The shallow cylinder portion 290 of the insulative washer 29 should have a height shorter than that of the battery 24 of button cell to ensure an electrical contact between the positive pole 242 of the battery 24 with the battery bracket 241.

The present invention is superior to the prior art as shown in FIG. 1 with the following advantages:

1. The restoring trigger switch 23*a* is directly formed on the printed circuit board 22 to eliminate the inconvenient welding or fixing jobs for mounting the flip-flap trigger switch 23 of the prior art on the printed circuit board 22 for saving production cost.
2. By further installing the photoresistive switch 28, the illuminators 26 may only be lit at night or darkness for saving power consumption of the battery 24 and for prolonging its service life.

Figure 7:
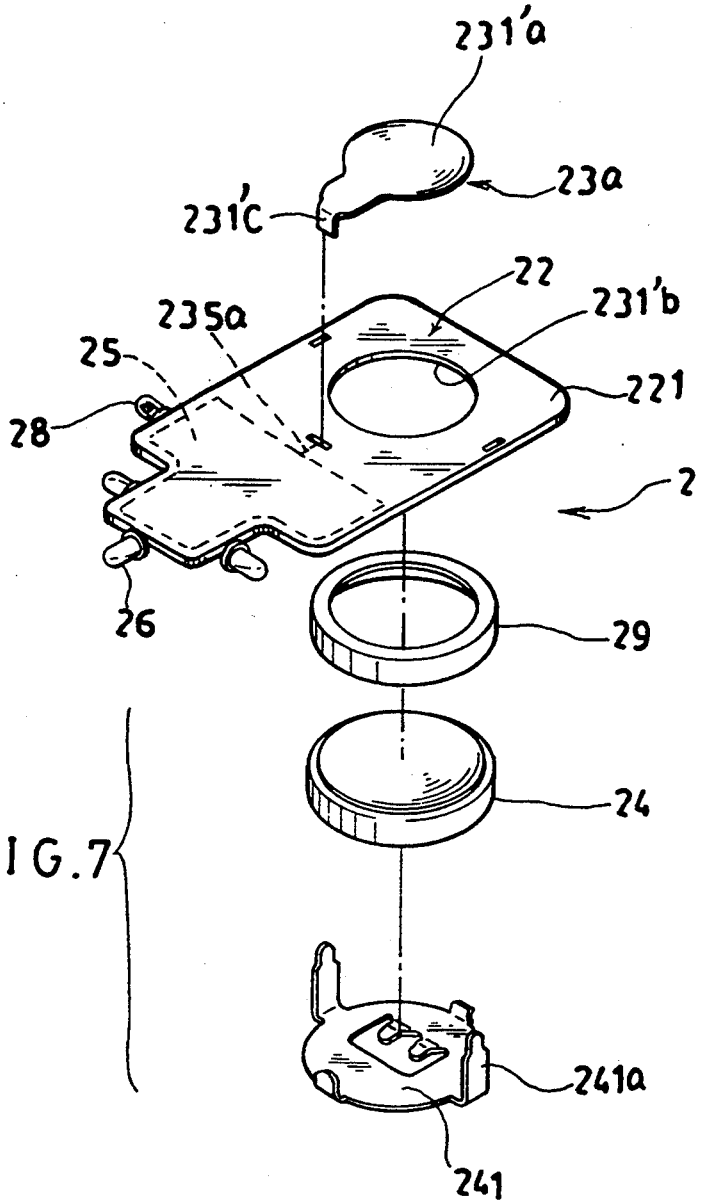
FIG. 7 is an exploded view of another preferred embodiment of the present invention.
Figure 8:
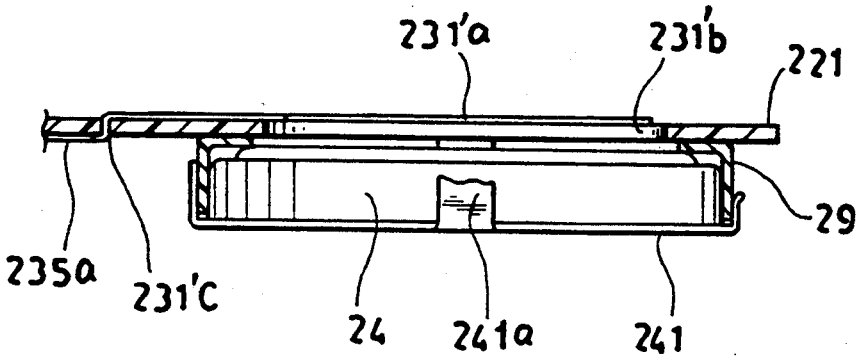
FIG. 8 is a partial sectional drawing of the embodiment as shown in FIG. 7.
Figure 9:
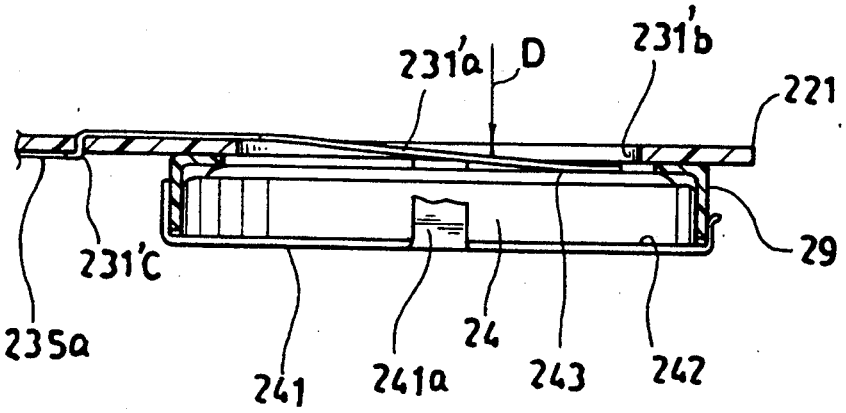
FIG. 9 shows a depressed condition of the present invention from the situation as shown in FIG. 8.

Another preferred embodiment of the present invention as shown in FIGS. 7–9, in which the resilient blade member 231'*a* has been modified to be an electrically conductive resilient blade member generally coplanar to an upper surface of the laminate sheet 221 by omitting the electrically conductive foil 241*d* as found in the aforementioned blade member 231*a*, a connecting lug 231'*c* is formed on a rear end portion of the resilient blade member 231'*a* to be fixed on the printed circuit board 22 to electrically connect the integrated circuit through the negative leading wire 235*a*, and a punching hole 231'*b* is punched through the laminate sheet 221 of the printed circuit board 22, whereby upon treading of the shoe by the user, the electrically conductive resilient blade member 231'*a* will be depressed downwardly to directly contact the negative pole 243 of the battery 24 for closing the contacts of the trigger switch 23*a* for triggering and powering the integrated circuit 25 and the illuminators 26; and upon releasing of the treading of the shoe, the resilient blade member 231'*a* will be automatically horizontally flattened by its self resilience for disconnecting the power supply of the battery 24.

I claim:

1. An illuminating means for use in a safety illuminated shoe comprising:

a retaining base made of electrically insulative material and embedded in a transparent holder formed in a shoe heel, a printed circuit board secured in an upper portion of the base and having an electrically insulative laminate sheet and an integrated circuit printed in the laminte sheet, a restoring trigger switch formed in the laminate sheet, a battery attached to the laminate sheet of the printed circuit board, a plurality of illuminators secured on the printed circuit board and controlled by the integrated circuit for a timing control of the illumination of the illuminators, a photoresistive switch electrically connected between the battery and the integrated circuit through the trigger switch for powering the illuminators and the integrated circuit at night, and an electrically insulative washer packed between a bottom of the laminate sheet of the printed circuit board and the battery to normally separate the trigger switch from the battery;

improvement which comprises:

said restoring trigger switch of the illuminating means including: a resilient blade member and directly punched from the electrically insulative laminate sheet of the printed circuit board to form a punching slit with a connector portion connecting the resilient blade member to the laminate sheet; an electrically conductive foil plated on a bottom of the resilient blade member and electrically connected to a trigger pin of the integrated circuit of the illuminating means by a negative leading wire; the battery formed as a button cell jacketed in the electrically insulative washer and held in a battery bracket and positioned under the resilient blade member, the battery bracket made of electrically conductive material having at least two clips secured to the laminate sheet of the printed circuit board with a positive pole formed on a bottom of the battery contacted with the battery socket, the clips and electrically connected to the integrated circuit through a positive leading wire and a soldering joint connecting each said clip of said battery bracket with the positive leading wire, and with a negative pole of the battery formed on a top of the battery positioned below and adjacent to the electrically conductive foil of the resilient blade member; and the electrically insulative washer having a shallow cylinder portion disposed around the battery of button cell, an annular rim formed on a top portion of the cylinder portion and defining a central opening within the annular rim with the annular rim packed between the laminate sheet of the printed circuit board with the negative pole of the battery for normally separating the electrically conductive foil from the negative pole of the battery;

whereby upon treading of the shoe, the resilient blade member will be depressed downwardly to allow the electrically conductive foil to contact the negative pole of the battery, thereby closing the trigger switch for triggering and powering the integrated circuit and the illuminators for illuminating the illuminators; and upon releasing of the treading of the shoe, the resilient blade member will be automatically restored by its self resilience to be horizontally straightened to disconnect the foil from the negative pole of the battery for opening the trigger switch.

2. An illuminating means according to claim 1, wherein said central opening of the insulative washer has an area larger than that of the resilient blade member, thereby allowing a downward depression of the blade member to contact the foil on the bottom of the blade member with the negative pole of the battery.

3. An illuminating means according to claim 1, wherein said shallow cylinder portion of the insulative washer has a height shorter than that of the battery of button cell to ensure an electrical contact between the positive pole of the battery with the battery bracket.

4. An illuminating means for use in a safety illuminated shoe comprising:

a retaining base made of electrically insulative material and embedded in a transparent holder formed in a shoe heel, a printed circuit board secured in an upper portion of the base and having an electrically insulative laminate sheet and an integrated circuit printed in the laminate sheet, a restoring trigger switch formed on the laminate sheet, a battery attached to the laminate sheet of the printed circuit board, a plurality of illuminators secured on the printed circuit board and controlled by the integrated circuit for a timing control of the illumination of the illuminators, a photoresistive switch electrically connected between the battery and the integrated circuit through the trigger switch for powering the illuminators and the integrated circuit at night, and an electrically insulative washer packed between a bottom of the laminate sheet of the printed circuit board and the battery to normally separate the trigger switch from the battery;

the improvement which comprises:

said restoring trigger switch of the illuminating means including: a resilient blade member and made of electrically conductive material and secured to the laminate sheet and electrically connected to a trigger pin of the integrated circuit of the illuminating means by a negative leading wire; the battery formed as a button cell jacketed in the electrically insulative washer and held in a battery bracket and positioned under the resilient blade member, the battery bracket made of electrically conductive material having at least two clips secured to the laminate sheet of the printed circuit board with a positive pole formed on a bottom of the battery contacted with the battery socket, the clips and electrically connected to the integrated circuit through a positive leading wire and a soldering joint connecting each said clip of said battery bracket with the positive leading wire, and with a negative pole of the battery formed on a top of the battery positioned below and adjacent to the resilient blade member; said laminate sheet punched with a punching hole therein allowing a downward depression of said resilient blade member to contact the negative pole of said battery upon a treading of the shoe for closing the trigger switch; and the insulative washer having a shallow cylinder portion disposed around the battery of button cell, an annular rim formed on a top portion of the cylinder portion and defining a central opening within the annular rim with the annular rim packed between the laminate sheet of the printed circuit board with the negative pole of the battery for normally separating the resilient blade member from the negative pole of the battery; and said blade member generally being coplanar to an upper surface of said laminate sheet to be normally separated from said battery and operatively depressed downwardly to contact the battery for triggering said integrated circuit and said illuminators.

* * * * *